US012295410B2

(12) United States Patent
Osborn

(10) Patent No.: US 12,295,410 B2
(45) Date of Patent: May 13, 2025

(54) WATERPIPE SYSTEM

(71) Applicant: Lee Osborn, Chatham (CA)

(72) Inventor: Lee Osborn, Chatham (CA)

( * ) Notice: Subject to any disclaimer, the term of this patent is extended or adjusted under 35 U.S.C. 154(b) by 229 days.

(21) Appl. No.: 17/549,200

(22) Filed: Dec. 13, 2021

(65) Prior Publication Data

US 2023/0180823 A1 Jun. 15, 2023

(51) Int. Cl.

| | |
|---|---|
| ***A24F 1/30*** | (2006.01) |
| ***A24F 7/02*** | (2006.01) |
| ***A24F 9/14*** | (2006.01) |

(52) U.S. Cl.

CPC ..... *A24F 1/30* (2013.01); *A24F 7/02* (2013.01); *A24F 9/14* (2013.01)

(58) Field of Classification Search

CPC ..... A24F 1/30

See application file for complete search history.

(56) References Cited

U.S. PATENT DOCUMENTS

| | | | | |
|---|---|---|---|---|
| 722,405 | A * | 3/1903 | Ganim | A24F 1/30 131/226 |
| 3,882,875 | A | 5/1975 | Frost | |
| D248,573 | S | 7/1978 | Graham | |
| D249,071 | S | 8/1978 | Shephard, Jr. | |
| D261,813 | S | 11/1981 | Sher | |
| D262,142 | S | 12/1981 | Sher | |
| D262,143 | S | 12/1981 | Sher | |
| D786,593 | S | 5/2017 | Almaghlouth | |
| 9,848,639 | B1 * | 12/2017 | Soares | A24F 1/30 |
| 2007/0215165 | A1 * | 9/2007 | Mazakis | A24F 1/30 131/257 |
| 2011/0186064 | A1 | 8/2011 | Patel | |
| 2014/0230832 | A1 * | 8/2014 | Saliman | A24F 1/30 131/173 |
| 2017/0128682 | A1 * | 5/2017 | Davidson | A61M 15/0086 |

FOREIGN PATENT DOCUMENTS

| | | |
|---|---|---|
| DE | 202014103475 | 9/2014 |
| DE | 402104001654-0001 | 12/2014 |
| DE | 402104001654-0002 | 12/2014 |
| DE | 402104001654-0003 | 12/2014 |
| DE | 202019001094 | 6/2019 |

OTHER PUBLICATIONS

Machine Translation of DE202014103475.
Machine Translation of DE202019001094.

* cited by examiner

*Primary Examiner* — Eric Yaary
(74) *Attorney, Agent, or Firm* — Preston Smirman; SMIRMAN IP LAW, PLLC

(57) ABSTRACT

A waterpipe system is described and includes a vessel having a round bottom, a first port member extending upwardly at an angle away from an upper portion of the vessel and a second port member spaced apart from the first port member, wherein the second port member extends vertically upwardly away from the upper portion of the vessel, and an optional stand system including a bottom member, a top member, and at least one leg member interconnecting the bottom and top members, wherein the top member includes an area defining an aperture formed in a central portion thereof, wherein the round bottom of the vessel is operable to rest upon a surface of the bottom member, wherein the second port member is operable to be received through the aperture such that an upper portion of the second port member extends above an upper surface of the top member.

3 Claims, 6 Drawing Sheets

WATERPIPE SYSTEM

FIELD OF THE INVENTION

The present invention relates generally to waterpipe systems, and more particularly to waterpipe systems that include a vessel having a round bottom, a first port member extending upwardly at an angle away from an upper portion of the vessel and a second port member spaced apart from the first port member, wherein the second port member extends vertically upwardly away from the upper portion of the vessel, and an optional stand system including a bottom member, a top member, and at least one leg member interconnecting the bottom and top members, wherein the top member includes an area defining an aperture formed in a central portion thereof, wherein the round bottom of the vessel is operable to rest upon a surface of the bottom member, wherein the second port member is operable to be received through the aperture such that an upper portion of the second port member extends above an upper surface of the top member.

BACKGROUND OF THE INVENTION

A waterpipe, also referred to variously as water pipe or bong, is a filtration device generally used for smoking tobacco, cannabis and/or other herbal substances.

In construction and function, a waterpipe is somewhat similar to a hookah, except generally smaller and especially more portable. A waterpipe may be constructed from any air- and water-tight, heat resistant vessel by adding a bowl and stem apparatus (or slide) which guides air downward to below a water level, wherein it bubbles upward during use. In use, the water can trap some heavier particles and water-soluble molecules, preventing them from entering the smoker's airways. The mechanics of a waterpipe are comparable to those of a laboratory gas washing bottle. For example, the user typically places the desired combustible substance in the bowl of the stem. After the bowl has been sufficiently packed and an appropriate amount of water has been placed into the waterpipe, the substance is then lit and the resulting smoke is drawn through the water to produce a supposedly smoother smoke than other methods of smoking do. To smoke a waterpipe, the smoker must inhale such that bubbles containing smoke begin to come from the stem. Once the waterpipe has a fair amount of smoke built up (e.g., above the water level), the user may remove the connection to the combustable/vaporizable material, while continuing to inhale, subsequently inhaling all of the diffused smoke or vapour from the waterpipe.

Conventional waterpipe systems are generally not configured to provide an optimal smoking experience in that combusted substance does not always adequately diffuse through the water and up into space above the water level, especially during the inhalation step. Additionally, conventional waterpipe systems are generally poorly designed, cumbersome and/or difficult to transport.

Accordingly, there exists a need for new and improved waterpipe systems that overcome the deficiencies set forth above.

SUMMARY OF THE INVENTION

In accordance with a first embodiment of the present invention, a waterpipe system is provided, including:

a vessel having a round bottom;

a first port member extending upwardly at an angle away from an upper portion of the vessel, wherein the first port member is in communication with an interior portion of the vessel;

a second port member spaced apart from the first port member, wherein the second port member extends vertically upwardly away from the upper portion of the vessel, wherein the second port member is in communication with an interior portion of the vessel;

a first insert member operable to be at least partially received within an opening of the first port member and extending at least partially into the interior portion of the vessel; and a second insert member operable to be at least partially received within an opening of the second port member and extending at least partially into the interior portion of the vessel.

In accordance with an aspect of the first embodiment, a first coupling member is operable to be at least partially received in an opening of the first insert member.

In accordance with an aspect of the first embodiment, a first hose member is operable to attach to an opening of the first coupling member.

In accordance with an aspect of the first embodiment, a mouthpiece member is operable to attach to an opening of the first hose member.

In accordance with an aspect of the first embodiment, a second coupling member is operable to be at least partially received in an opening of the second insert member.

In accordance with an aspect of the first embodiment, a second hose member is operable to attach to an opening of the second coupling member.

In accordance with an aspect of the first embodiment, a source of a vaporizable or combustible material is in communication with the second hose member.

In accordance with an aspect of the first embodiment, a stand system includes a bottom member, a top member, and at least one leg member interconnecting the bottom and top members.

In accordance with an aspect of the first embodiment, the top member includes an area defining an aperture formed in a central portion thereof.

In accordance with an aspect of the first embodiment, the round bottom of the vessel is operable to rest upon a surface of the bottom member.

In accordance with an aspect of the first embodiment, the second port member is operable to be received through the aperture such that an upper portion of the second port member extends above an upper surface of the top member.

In accordance with a second embodiment of the present invention, a waterpipe system is provided, including:

a vessel having a round bottom;

a first port member extending upwardly at an angle away from an upper portion of the vessel, wherein the first port member is in communication with an interior portion of the vessel;

a second port member spaced apart from the first port member, wherein the second port member extends vertically upwardly away from the upper portion of the vessel, wherein the second port member is in communication with an interior portion of the vessel;

a first insert member operable to be at least partially received within an opening of the first port member and extending at least partially into the interior portion of the vessel;

a second insert member operable to be at least partially received within an opening of the second port member and extending at least partially into the interior portion of the vessel;

a first coupling member operable to be at least partially received in an opening of the first insert member;

a first hose member operable to attach to an opening of the first coupling member;

a mouthpiece member operable to attach to an opening of the first hose member;

a second coupling member operable to be at least partially received in an opening of the second insert member;

a second hose member operable to attach to an opening of the second coupling member; and a source of a vaporizable or combustible material in communication with the second hose member.

In accordance with an aspect of the second embodiment, a stand system includes a bottom member, a top member, and at least one leg member interconnecting the bottom and top members.

In accordance with an aspect of the second embodiment, the top member includes an area defining an aperture formed in a central portion thereof.

In accordance with an aspect of the second embodiment, the round bottom of the vessel is operable to rest upon a surface of the bottom member.

In accordance with an aspect of the second embodiment, the second port member is operable to be received through the aperture such that an upper portion of the second port member extends above an upper surface of the top member.

In accordance with a third embodiment of the present invention, a waterpipe system is provided, including:

a vessel having a round bottom;

a first port member extending upwardly at an angle away from an upper portion of the vessel, wherein the first port member is in communication with an interior portion of the vessel;

a second port member spaced apart from the first port member, wherein the second port member extends vertically upwardly away from the upper portion of the vessel, wherein the second port member is in communication with an interior portion of the vessel;

a first insert member operable to be at least partially received within an opening of the first port member and extending at least partially into the interior portion of the vessel;

a second insert member operable to be at least partially received within an opening of the second port member and extending at least partially into the interior portion of the vessel;

a first coupling member operable to be at least partially received in an opening of the first insert member;

a first hose member operable to attach to an opening of the first coupling member;

a mouthpiece member operable to attach to an opening of the first hose member;

a second coupling member operable to be at least partially received in an opening of the second insert member;

a second hose member operable to attach to an opening of the second coupling member;

a source of a vaporizable or combustible material in communication with the second hose member; and a stand system including a bottom member, a top member, and at least one leg member interconnecting the bottom and top members;

wherein the top member includes an area defining an aperture formed in a central portion thereof;

wherein the round bottom of the vessel is operable to rest upon a surface of the bottom member;

wherein the second port member is operable to be received through the aperture such that an upper portion of the second port member extends above an upper surface of the top member.

BRIEF DESCRIPTION OF THE DRAWINGS

By way of example, embodiments of the present invention will now be described with reference to the accompanying figures of drawings in which.

DETAILED DESCRIPTION OF THE INVENTION

In the following detailed description of the invention, numerous specific details are set forth in order to provide a thorough understanding of the invention. However, it will be obvious to one skilled in the art that the invention may be used without these specific details. In other instances well-known methods, procedures, components, and elements are not described here in detail so as not to unnecessarily obscure aspects of the invention. It will be readily understood that the components of the present invention, as generally described and illustrated in the figures, may be arranged and designed in a wide variety of different configurations. Thus, the following more detailed description of the embodiments of the devices and methods of the present invention, as represented in the figures, is not intended to limit the scope of the invention, but is merely representative of selected embodiments of the invention.

Figure 1:
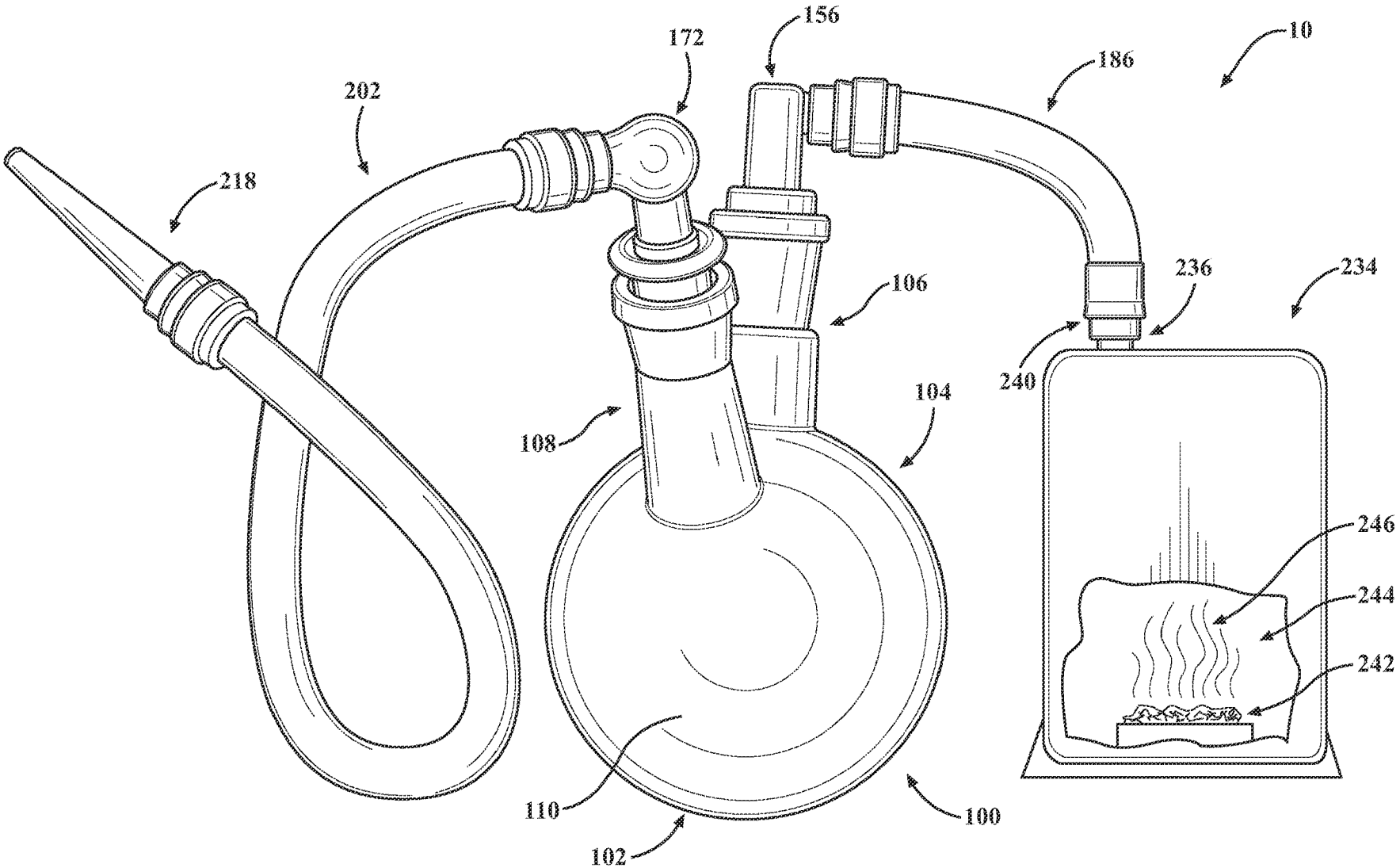
FIG. 1 is a schematic view of an embodiment of a waterpipe system, in accordance with the general teachings of the present invention.
Figure 2:
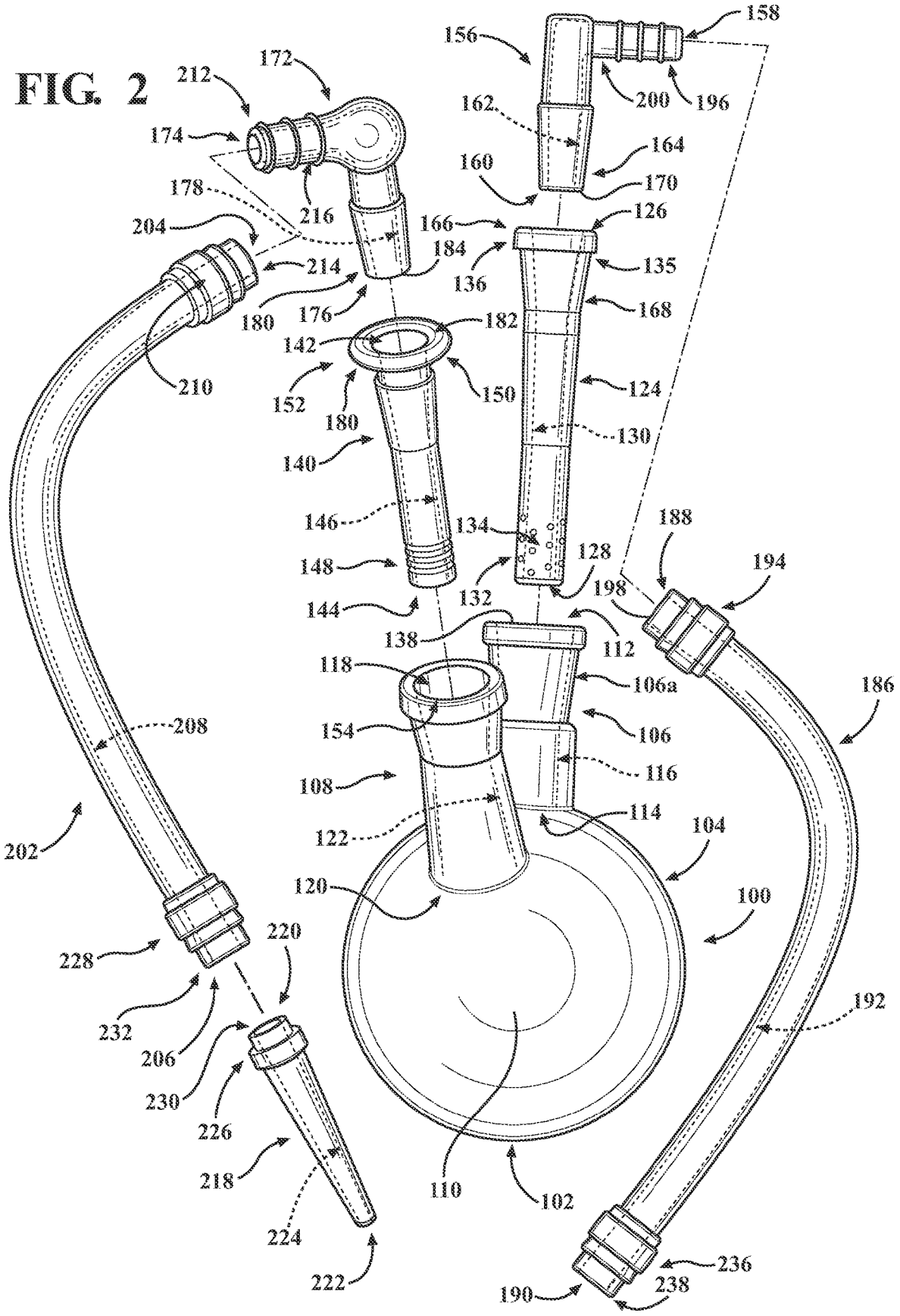
FIG. 2 is an exploded view of an embodiment of a waterpipe system, in accordance with the general teachings of the present invention.
Figure 3:
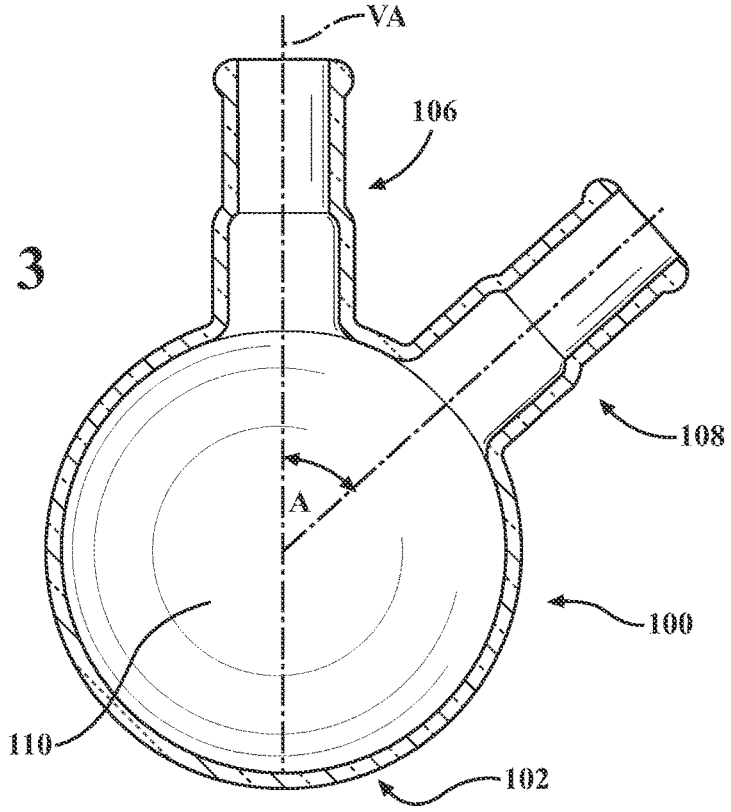
FIG. 3 is a sectional view of a vessel member for a waterpipe system, in accordance with the general teachings of the present invention.
Figure 7:
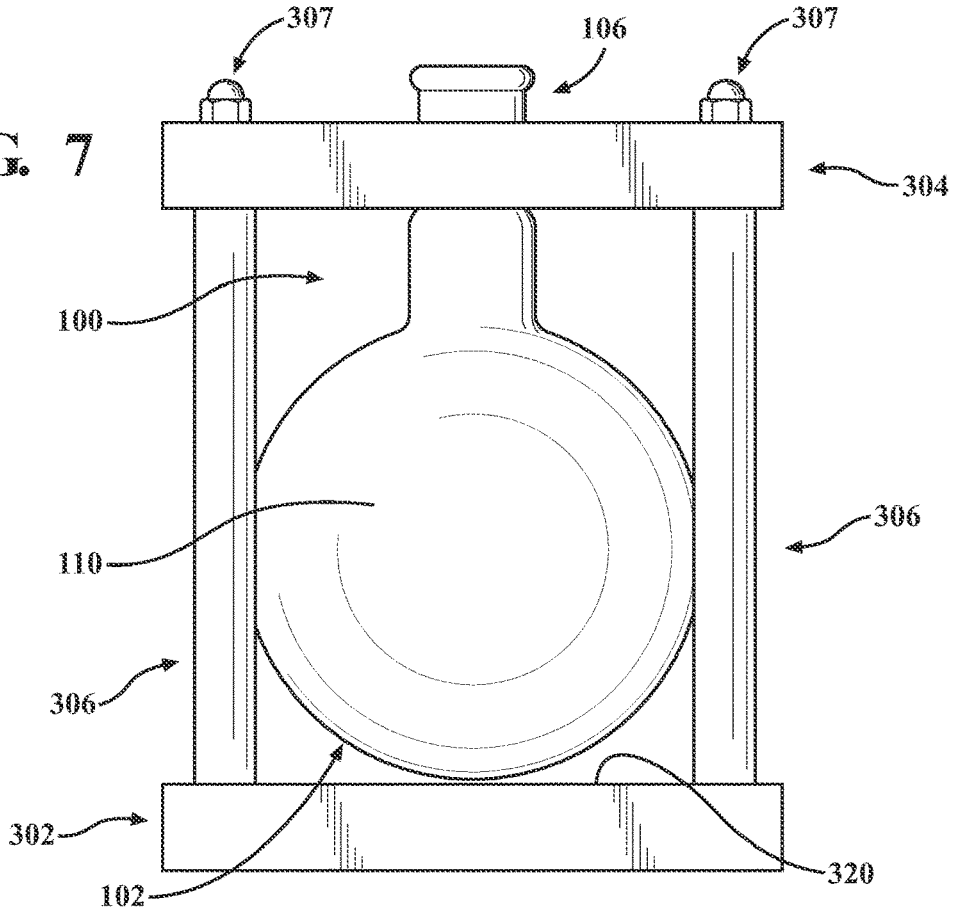
FIG. 7 is a rear elevational view of a vessel member for a waterpipe system housed within a stand member, in accordance with the general teachings of the present invention.
Figure 4:
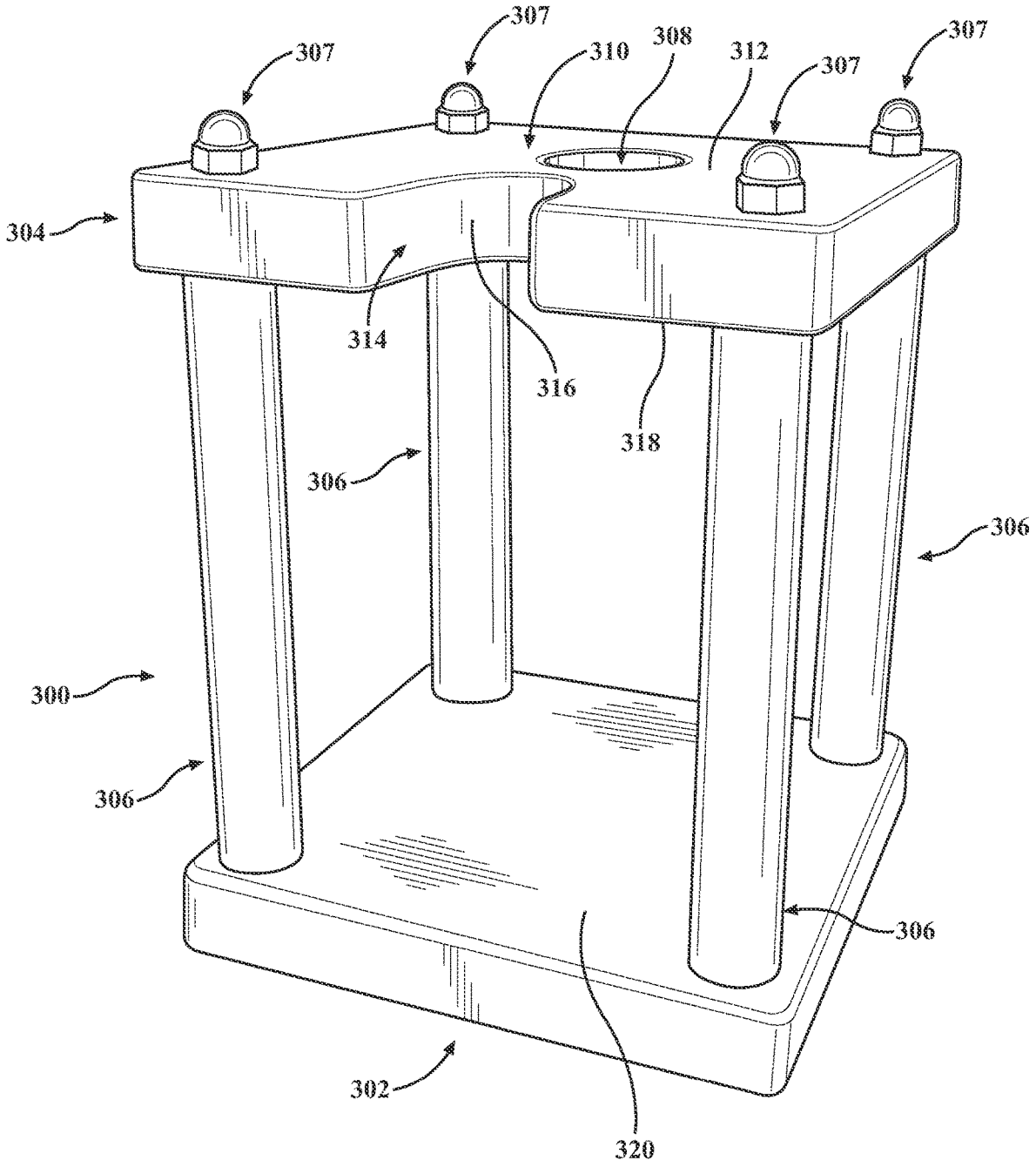
FIG. 4 is a perspective view of a stand member for a waterpipe system, in accordance with the general teachings of the present invention.
Figure 5:
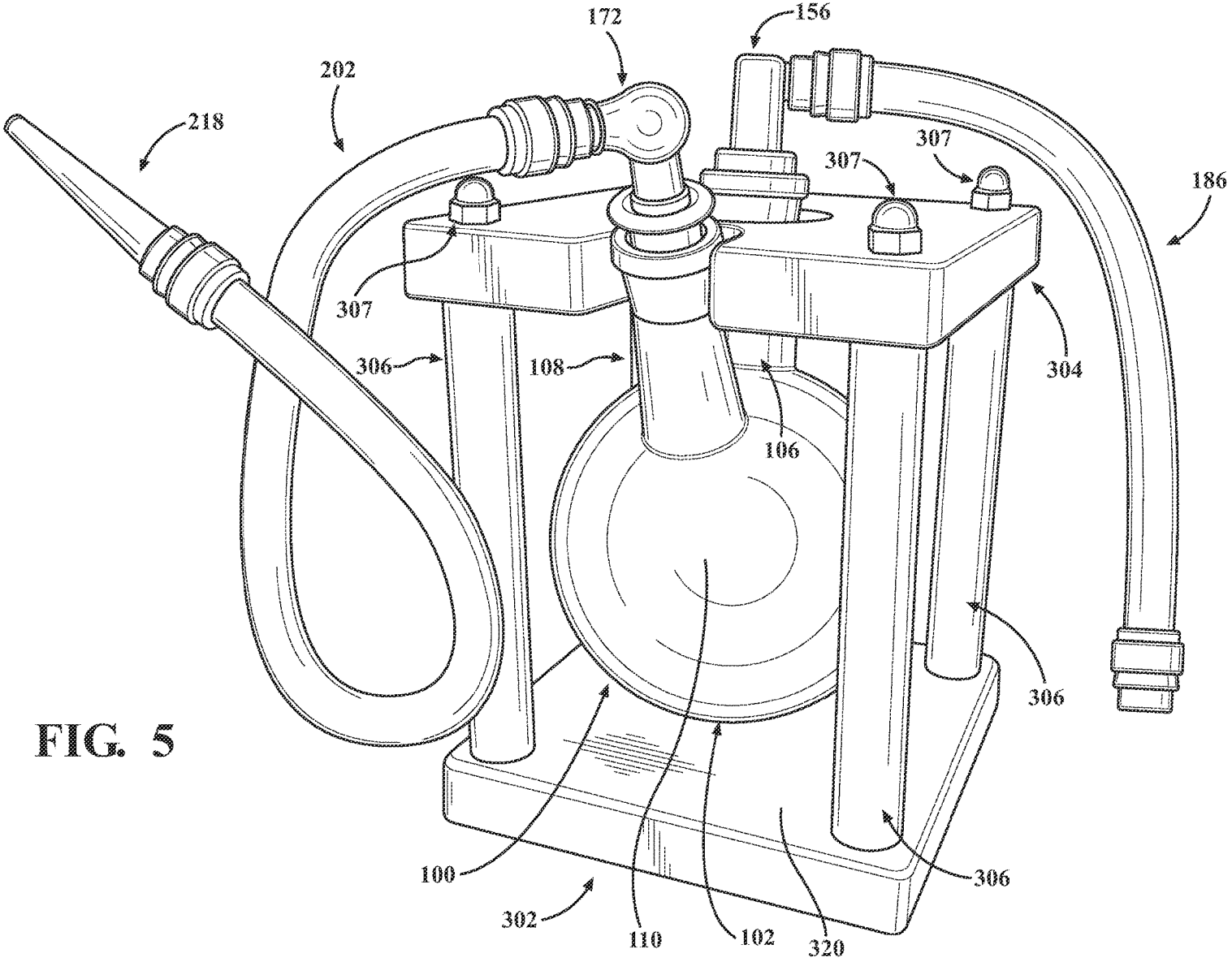
FIG. 5 is a schematic view of an embodiment of a waterpipe system housed within a stand member, in accordance with the general teachings of the present invention.
Figure 6:
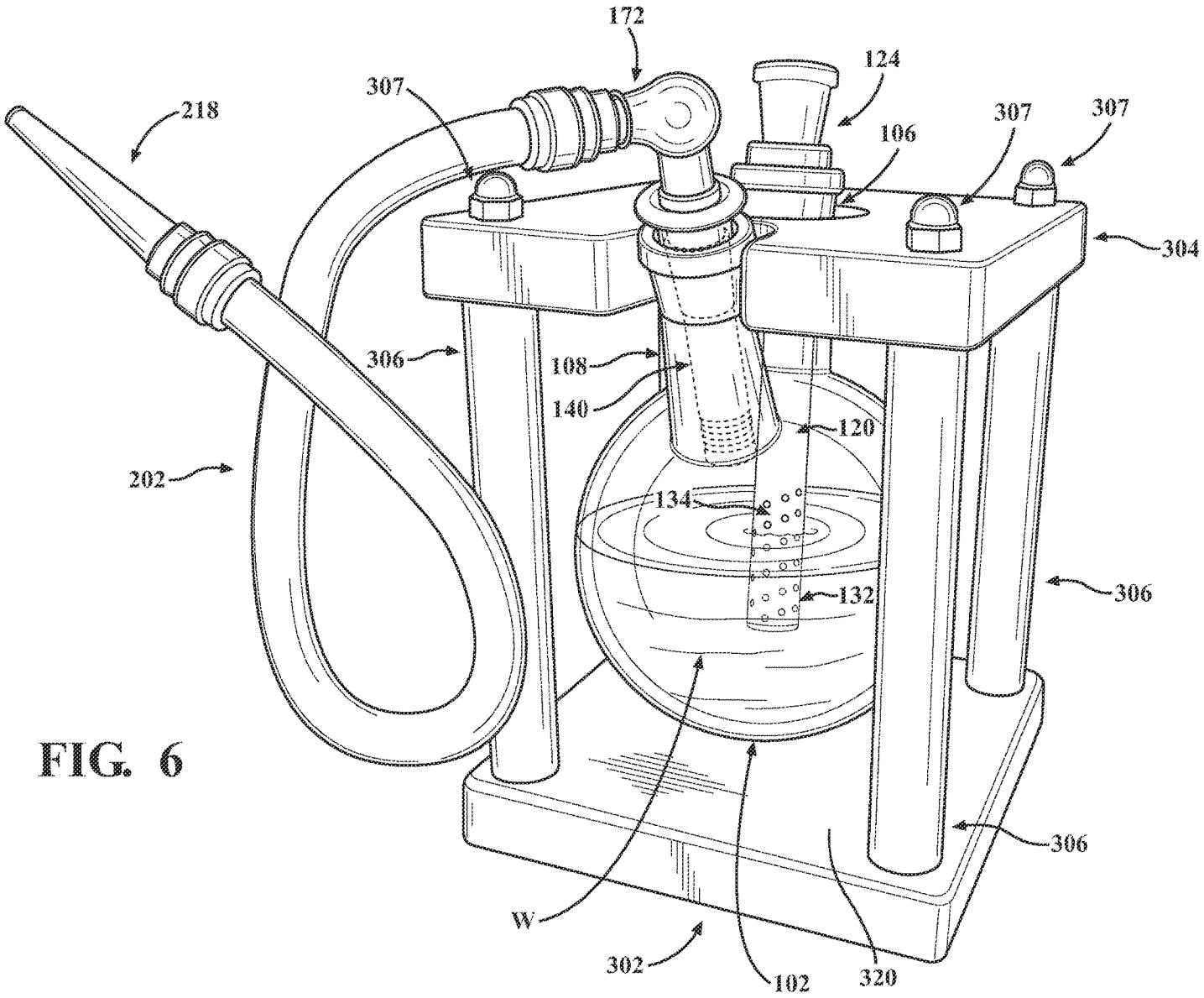
FIG. 6 is a schematic view of an embodiment of a waterpipe system having an amount of water disposed within the vessel member thereof and housed within a stand member, in accordance with the general teachings of the present invention.

Referring specifically to FIGS. 1-3, there is shown a waterpipe system generally at 10. The system 10 includes a vessel 100. This type of vessel is commonly referred to as a round bottom boiling flask. The vessel 100 and/or a similar product are readily commercially available from StonyLab, Nesconset, N.Y., and marketed under the product descriptions of 2 Neck RBF 19/22 Flasks Borosilicate Glass XL-815034 250 ml and XL-815035 500 ml. By way of a non-limiting example, the vessel 100 may be constructed from glass, acrylic and/or other suitable materials.

The vessel 100 is generally round in configuration with a round and/or rounded bottom portion 102. A top portion 104 of the vessel 100, which is also generally round in configuration, is provided with a first port 106 and a second port 108, both of which are in fluid communication with an inner portion 110 of the vessel 100.

The first port 106 is shown as being vertically oriented at an angle of 0 degrees with respect to a vertical axis VA extending through the vessel 100. Although the angle is shown as being at 0 degrees, it should be appreciated that the angle may vary slightly from 0 degrees relative to the top portion 104. By way of a non-limiting example, the angle may vary from 0 to 3 degrees and/or from about 0 to about 3 degrees.

The second port 108 is shown as being angled with respect to the first port 106 axis. It should be appreciated that the angle A shown may vary from 25 to 80 degrees and/or about 25 to about 90 degrees, relative to the first port 106 in either a downward or upward adjustment.

The first port 106 includes a first open end 112, a second open end 114 and a through bore 116 formed therebetween. In this manner, fluid communication from the first open 112 can be established with the inner portion 110 of the vessel 100.

The second port 108 includes a first open end 118, a second open end 120 and a through bore 122 formed therebetween. In this manner, fluid communication from the first open 118 can be established with the inner portion 110 of the vessel 100.

A first insert member 124 includes a first open end 126, a second open end 128 and a through bore 130 formed therebetween. The first insert member 124 and/or a similar product is readily commercially available from Ace-Labz, Long Beach, Calif. It is commercially referred to as a "downstem" or "down stem." By way of a non-limiting example, the first insert member 124 may be constructed from glass, metal, silicone and/or other suitable materials.

At a distal end 132 thereof, there is provided with a plurality of apertures 134 formed therein, the purpose of which will be described herein. The first insert member 124 is intended to be at least partially received in the through bore 116 of the first port 106. By way of a non-limiting example, when the first insert member 124 is fully inserted into the through bore 116 of the first port 106, the distal end 132 preferably extends well into the inner portion 110 of the vessel 100. By way of a non-limiting example, when the first insert member 124 is fully inserted into the through bore 116 of the first port 106, a top portion 135 of a proximal end 136 thereof preferably engages a surface 138 of the first port 106 such that the first insert member 124 cannot inadvertently fall completely into the inner portion 110 of the vessel 100.

A second insert member 140 includes a first open end 142, a second open end 144 and a through bore 146 formed therebetween. The second insert member 140 and/or a similar product is readily commercially available from SMOKEA, OFallon, Mo. and is marketed under the product name SMOKEA 18 mm/14 mm Flush Mount Glass on Glass Downstem Diffuser DS181425 2.5 inch. By way of a non-limiting example, the second insert member 140 may be constructed from glass, metal, silicone and/or other suitable materials.

The second insert member 140 is intended to be at least partially received in the through bore 122 of the second port 108. By way of a non-limiting example, when the second insert member 140 is fully inserted into the through bore 122 of the second port 108, the distal end 148 does not extend past the second open end 120. By way of a non-liming example, when the second insert member 140 is fully inserted into the through bore 122 of the second port 108, a top portion 150 of a proximal end 152 thereof preferably engages a surface 154 of the second port 108 such that the second insert member 140 cannot inadvertently fall completely into the inner portion 110 of the vessel 100.

It should be noted that before both insert members 124, 140, respectively, are inserted into their respective ports 106, 108, an amount of water W or other suitable fluid should be introduced into the vessel 100 to a desired level. Water W may be introduced once either of insert members 124, 140, respectively, has been inserted into their respective ports 106, 108; however, it may be more difficult to do so due to the relative sizing of the respective openings of the insert members 124, 140, respectively.

A first coupling member 156 includes a first open end 158, a second open end 160 and a through bore 162 formed therebetween. The first coupling member 156 and/or a similar product is readily commercially available from StonyLab, Nesconset, N.Y. and is marketed under the product name Glass 90 Degree Vacuum/Gas Inlet Adapter for Laboratory Lab Supply Borosilicate Glass SKU: XL-815877. By way of a non-limiting example, the first coupling member 156 may be constructed from glass, metal or silicone and/or other suitable materials.

A distal portion 164 of the first coupling member 156 is intended to be at least partially received in the through bore 130 of the first insert member 124. By way of a non-limiting example, when the first coupling member 156 is fully inserted into the through bore 130 of the first insert member 124, a top portion 166 of a proximal end 168 thereof preferably engages a surface 170 of the first coupling member 156 such that the first coupling member 156 cannot inadvertently fall completely into the through bore 130 of the first insert member 124.

A second coupling member 172 includes a first open end 174, a second open end 176 and a through bore 178 formed therebetween. The second coupling member 172 and/or a similar product is readily commercially available from StonyLab, Nesconset, N.Y. and is marketed under the product name Glass 90 Degree Vacuum/Gas Inlet Adapter for Laboratory Lab Supply Borosilicate Glass SKU: XL-815877. By way of a non-limiting example, the second coupling member 172 may be constructed from glass, metal, silicone and/or other suitable materials.

A distal portion 180 of the second coupling member 172 is intended to be at least partially received in the through bore 146 of the second insert member 140. By way of a non-limiting example, when the second coupling member 172 is fully inserted into the through bore 146 of the second insert member 140, a top portion 180 of a proximal end 182 thereof preferably engages a surface 184 of the second insert member 140 such that the second coupling member 172 cannot inadvertently fall completely into the through bore 146 of the second insert member 140.

A first hose member 186 includes a first open end 188, a second open end 190 and a through bore 192 formed therebetween. The first hose member 186 and/or a similar product is readily commercially available from MoreBeer, Concord, Calif. and is marketed under the product name High Temp Silicone Tubing—½ in. (e.g., this product is odorless, tasteless, and inert silicone tubing that is FDA food-grade approved for use from −100 F to 500 F). By way of a non-limiting example, the first hose member 186 may be constructed from silicone and/or other suitable materials.

A proximal portion 194 of the first hose member 186 is intended to engage the distal end 196 of the first coupling member 156. By way of a non-limiting example, when the first hose member 186 is fully inserted onto the distal end 196 of the first coupling member 156, a first end portion 198 of the first hose member 186 thereof preferably engages a surface 200 of the first coupling member 156.

A second hose member 202 includes a first open end 204, a second open end 206 and a through bore 208 formed therebetween. The second hose member 202 and/or a similar product is readily commercially available from MoreBeer, Concord, Calif. and is marketed under the product name High Temp Silicone Tubing—½ in. (e.g., this product is odorless, tasteless, and inert silicone tubing that is FDA food-grade approved for use from −100 F to 500 F). By way of a non-limiting example, the second hose member 204 may be constructed from silicone and/or other suitable materials.

A proximal portion 210 of the second hose member 202 is intended to engage the distal end 212 of the second coupling member 172. By way of a non-limiting example, when the second hose member 202 is fully inserted onto the distal end 212 of the second coupling member 172, a first end portion 214 of the second hose member 202 thereof preferably engages a surface 216 of the second coupling member 172.

A mouthpiece member 218 includes a first open end 220, a second open end 222 and a through bore 224 formed therebetween. The mouthpiece member 218 and/or a similar product is readily commercially available from Arizer, Waterloo, Ontario, Canada and is marketed under the product name Glass Whip Mouthpiece. By way of a non-limiting example, the mouthpiece member 218 may be constructed from wood, glass, metal, plastic, silicone and/or other suitable materials.

A proximal portion 226 of the mouthpiece member 218 is intended to engage the distal end 228 of the first hose member 186. By way of a non-liming example, when the mouthpiece member 218 is fully inserted onto the distal end 228 of the first hose member 186, a first end portion 230 of the mouthpiece member 218 thereof preferably engages a surface 232 of the first hose member 186.

A vaporizer or combustion system 234 includes an open end 236. The vaporizer or combustion system 234 and/or a similar product is readily commercially available from online retailer Planet of the Vapes (https://www.planetofthevapes.com/) and marketed under the product names DynaVap 2021 Vong vaporizer, Storz and Bickel Mighty vaporizer. The open end 236 of the vaporizer or combustion system 234 is intended to engage the distal end 236 of the first hose member 186. By way of a non-limiting example, when the distal end 236 of the first hose member 186 is fully inserted onto the open end 236 of the vaporizer or combustion system 234, a first end portion 238 of the first hose member 186 thereof preferably engages a surface 240 of the open end 236 of the vaporizer or combustion system 234. A vaporizable/combustible material 242 (e.g., tobacco, *cannabis* and/or other herbal substances) is intended to be introduced into an internal space 244 of the vaporizer or combustion system 234, and at an appropriate time, vaporized/combusted such that vapors, fumes and/or smoke 246 of the vaporizable/combustible material 242 may be drawn upwardly through the open end 236 of the vaporizer or combustion system 234 and eventually into the inner portion 110 of the vessel 100, as will be described herein.

Referring specifically to FIGS. 4-7, an optional stand system generally at 300 includes a bottom member 302, a top member 304, and at least one leg member 306 interconnecting the bottom and top members. Although four leg members 306 are shown, it should be appreciated that either less than or more than this number can be provided in the practice of the present invention. By way of a non-limiting example, the bottom member 302 and/or the top member 304 may be constructed from wood, metal or plastic. By way of a non-limiting example, the leg member 306 may be constructed from wood, metal, plastic and/or other suitable materials.

It should be appreciated that the stand system 300 can be assembled by inserting and tightening the fasteners 307 (e.g., screws) that interconnect the bottom member 302 and the top member 304, e.g., via the leg members 306.

It should also be appreciated that the stand system 300 can be disassembled by loosening and removing the fasteners 307 (e.g., screws) that interconnect the bottom member 302 and the top member 304, e.g., via the leg members 306.

By way of a non-limiting example, the top member 304 includes an area defining an aperture 308 formed in a central portion 310 thereof. The intended purpose of the aperture 308 is to permit the first port 106 to be received through the aperture 308 such that an upper portion **106*a*, and especially the first open end 112, extends above an upper surface 312 of the top member 304**.

By way of a non-limiting example, the top member 304 includes an area defining an indentation 314 formed in an edge portion 316 thereof. The intended purpose of the indentation 314 is to permit the second port 108 to be rest against the indentation 314, e.g., when the first port 106 is received through the aperture 308.

To insert the first port 106 into the aperture 308, the user simply tilts the vessel 100 slightly such that the first port 106 enters the aperture 308 through a lower surface 318 of the top member 304, continues to tilt the vessel 100 slightly such that the first port 106 travels further upwardly through the aperture 308, and finally, continues to tilt the vessel 100 slightly such that the first port 106 emerges from the aperture 308 and extends above the upper surface 312 of the top member 304. In this position, the second port 108 should now be resting against the indentation 314.

While it may be possible to first insert the first insert member 124 into the first port 106 prior to attempting to negotiate the aperture 308 during the insertion process, it is generally recommended to insert the first insert member 124 into the first port 106 after the first port 106 has already been fully inserted into the aperture to make the insertion process relatively easier and prevent any damage to first port 106. Likewise, the disassembly process should be done only once the first insert member 124 has been removed from the first port 106. Again, this will make the disassembly process relatively easier and prevent any damage to first port 106.

Once the first port 106 has been finally inserted into the aperture 308, as described above, the rounded bottom portion 102 of the vessel 100 is then operable to rest upon a top 320 surface of the bottom member 302. In this manner, the weight of the system 10 is at least partially borne by the top 320 surface of the bottom member 302. In this position, the system 10 is secured within the stand system 300 such that the vessel 10 cannot easily be dislodged therefrom (e.g., during transport). That is, once the first port 106 is received through the aperture 308 such that an upper portion **106*a*, and especially the first open end 112, extends above an upper surface 312 of the top member 304, any movement of the upper portion 106*a* may be restricted due to the aperture 308 being sized to prevent excessive movement of the first port 106, e.g., by sizing the aperture to be slightly larger than the diameter of the first port 106, but not so small or tight as to prevent relatively easy insertion/removal of the first port 106 from the aperture 308**.

Once the system 10 has been fully assembled as set forth above, the user is then able to operate the system 10 assuming the water W and the vaporizable/combustible material 242 are present in suitable amounts. For example, the vaporizable/combustible material 242 is combusted by the vaporizer or combustion system 234 which causes the vapors, fumes and/or smoke 246 to rise upwardly out of the vaporizer or combustion system 234, through the first hose member 186, through the first coupling member 156, through the plurality of apertures 134 of the first insert member 124 and, finally, into the water W. The vapors, fumes and/or smoke 246 diffuse into the water W and eventually a smoke column emerges above the surface of the water W. This process is aided by the user inhaling on the mouthpiece member 220, thus causing bubbling at the site of the plurality of apertures 134 of the first insert member 124, which in turn, enhances the diffusion of the vapors, fumes and/or smoke 246 diffuse into the water W, thus improving the smoking experience of the user.

Although an illustrative embodiment has been shown and described, a wide range of modification change and substitution is contemplated in the foregoing disclosure, and in some instances, some features of the embodiment may be employed without a corresponding use of other features. Accordingly, it is appropriate that the appended claims are construed broadly and in a manner consistent with the scope of the embodiment disclosed herein.

What is claimed is:

1. A waterpipe system, comprising:

a round vessel having a round bottom surface;

a first port member extending upwardly at an angle away from an upper portion of the round vessel, wherein the first port member is in communication with an interior portion of the round vessel;

a second port member spaced apart from the first port member, wherein the second port member extends vertically upwardly away from the upper portion of the round vessel, wherein the second port member is in communication with the interior portion of the round vessel;

a first insert member operable to be at least partially received within an opening of the first port member and extending at least partially into the interior portion of the round vessel;

a second insert member operable to be at least partially received within an opening of the second port member and extending at least partially into the interior portion of the round vessel, wherein the second insert member includes a plurality of apertures formed about a periphery extending from a medial to a distal wall portion thereof;

a first coupling member operable to be at least partially received in an opening of the first insert member;

a first hose member operable to attach to an opening of the first coupling member;

a mouthpiece member operable to attach to an opening of the first hose member;

a second coupling member operable to be at least partially received in an opening of the second insert member;

a second hose member operable to attach to an opening of the second coupling member;

a source of a vaporizable or combustible material in communication with the second hose member; and a stand system including a bottom member, a top member, and at least one leg member interconnecting the bottom and top members;

wherein the top member includes an area defining an aperture formed in a central portion thereof;

wherein the round bottom surface of the round vessel is operable to rest upon a surface of the bottom member;

wherein the second port member is operable to be received through the aperture such that an upper portion of the second port member extends above an upper surface of the top member.

2. A waterpipe system, comprising:

a round vessel having a round bottom surface;

a first port member extending upwardly at an angle away from an upper portion of the round vessel, wherein the first port member is in communication with an interior portion of the round vessel;

a second port member spaced apart from the first port member, wherein the second port member extends vertically upwardly away from the upper portion of the round vessel, wherein the second port member is in communication with the interior portion of the round vessel;

a first insert member operable to be at least partially received within an opening of the first port member and extending at least partially into the interior portion of the round vessel;

a second insert member operable to be at least partially received within an opening of the second port member and extending at least partially into the interior portion of the round vessel, wherein the second insert member includes a plurality of apertures formed about a periphery extending from a medial to a distal wall portion thereof;

a first coupling member operable to be at least partially received in an opening of the first insert member;

a first hose member operable to attach to an opening of the first coupling member;

a mouthpiece member operable to attach to an opening of the first hose member;

a second coupling member operable to be at least partially received in an opening of the second insert member;

a second hose member operable to attach to an opening of the second coupling member;

a source of a vaporizable or combustible material in communication with the second hose member; and a stand system including a bottom member, a top member, and at least two spaced apart leg members interconnecting the bottom and top members;

wherein the top member includes an area defining an aperture formed in a central portion thereof;

wherein the round bottom surface of the round vessel is operable to rest upon a surface of the bottom member;

wherein the second port member is operable to be received through the aperture such that an upper portion of the second port member extends above an upper surface of the top member.

3. A waterpipe system, comprising:

a round vessel having a round bottom surface;

a first port member extending upwardly at an angle away from an upper portion of the round vessel, wherein the first port member is in communication with an interior portion of the round vessel;

a second port member spaced apart from the first port member, wherein the second port member extends vertically upwardly away from the upper portion of the round vessel, wherein the second port member is in communication with the interior portion of the round vessel;

a first insert member operable to be at least partially received within an opening of the first port member and extending at least partially into the interior portion of the round vessel;

a second insert member operable to be at least partially received within an opening of the second port member and extending at least partially into the interior portion of the round vessel, wherein the second insert member includes a plurality of apertures formed about a periphery extending from a medial to a distal wall portion thereof;

a first coupling member operable to be at least partially received in an opening of the first insert member;

a first hose member operable to attach to an opening of the first coupling member;

a mouthpiece member operable to attach to an opening of the first hose member;

a second coupling member operable to be at least partially received in an opening of the second insert member;

a second hose member operable to attach to an opening of the second coupling member;

a source of a vaporizable or combustible material in communication with the second hose member; and a stand system including a bottom member, a top member, and four spaced apart leg members interconnecting the bottom and top members;

wherein the top member includes a first area defining an aperture formed in a central portion thereof;

wherein the top member includes a second area defining a curved indentation formed in a peripheral portion thereof;

wherein the round bottom surface of the round vessel is operable to rest upon a surface of the bottom member;

wherein the second port member is operable to be received through the aperture such that an upper portion of the second port member extends above an upper surface of the top member;

wherein the first port member is operable to be at least partially received in the curved indentation such that an upper portion of the first port member extends above the upper surface of the top member.

* * * * *